US006422698B2

(12) United States Patent
Kaiser

(10) Patent No.: US 6,422,698 B2
(45) **Date of Patent: *Jul. 23, 2002**

(54) INK JET MARKER

(75) Inventor: Richard J. Kaiser, Allentown, PA (US)

(73) Assignee: Binney & Smith Inc., Easton, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/848,065

(22) Filed: Apr. 28, 1997

(51) Int. Cl.[7] ..... B41J 3/36; B41J 2/21
(52) U.S. Cl. ..... 347/109; 347/43
(58) Field of Search ..... 347/109, 68, 10, 347/43, 41; 400/88; 346/3, 143

(56) References Cited

U.S. PATENT DOCUMENTS

| | | | | | |
|---|---|---|---|---|---|
| 3,683,212 | A | | 8/1972 | Zoltan | 310/328 |
| 3,747,120 | A | | 7/1973 | Stemme | 346/3 |
| 3,832,579 | A | | 8/1974 | Arndt | 310/326 |
| 3,940,773 | A | | 2/1976 | Mizoguchi et al. | 347/68 |
| 4,072,958 | A | | 2/1978 | Hayami et al. | 347/10 |
| 4,161,670 | A | | 7/1979 | Kern | 310/317 |
| 4,412,232 | A | * | 10/1983 | Weber et al. | 347/68 |
| 4,412,233 | A | * | 10/1983 | Thomas et al. | 347/85 |
| 4,459,601 | A | | 7/1984 | Howkins | 347/68 |
| 4,549,243 | A | * | 10/1985 | Owen et al. | 347/109 |
| 4,743,924 | A | * | 5/1988 | Scardovi | 347/10 |
| 4,746,936 | A | | 5/1988 | Takahashi | |
| 4,748,460 | A | * | 5/1988 | Piatt et al. | 347/109 |
| 5,220,342 | A | * | 6/1993 | Moriyama | 347/41 |
| 5,274,400 | A | | 12/1993 | Johnson et al. | 347/43 |
| 5,387,976 | A | * | 2/1995 | Lesniak | 347/100 |
| 5,501,535 | A | * | 3/1996 | Hastings et al. | 347/109 |
| 5,593,236 | A | * | 1/1997 | Bobry | 400/88 |
| 5,634,730 | A | * | 6/1997 | Bobry | 400/88 |
| 5,654,744 | A | * | 8/1997 | Nicoloff, Jr. et al. | 347/43 |
| 5,861,877 | A | * | 1/1999 | Kagayama et al. | 345/179 |
| 2001/0013887 | A1 | | 8/2001 | Kaiser | |

FOREIGN PATENT DOCUMENTS

| | | |
|---|---|---|
| DE | 25 37 767 C2 | 9/1977 |
| GB | 1350836 | 4/1974 |
| JP | 04129757 A | 4/1992 |
| JP | 06115168 A | 4/1994 |
| JP | 07061048 A | 3/1995 |
| JP | 2000103063 A | 4/2000 |
| RU | 2108915 C | 4/1998 |
| WO | WO 01/30589 A1 | 5/2001 |

OTHER PUBLICATIONS

"Ink–Jet Printing," by J. Heinzel et al., *Advances In Electronics and Electron Physics,* vol. 65, pp. 91–171.
"Recent Advances In Ink Jet Technology," by J.G. Martner, pp. 364–372.
"A Review of Ink–Jet Printing," by Doane, *Journal of Applied Photographic Engineering,* vol. 7, No. 5, Oct. 1981, pp. 121–125.

* cited by examiner

*Primary Examiner*—Thinh Nguyen
(74) *Attorney, Agent, or Firm*—Leydig, Voit & Mayer, Ltd.; John M. Augustyn

(57) ABSTRACT

An ink jet marker includes a writing instrument body with a cartridge disposed therein. A printing nozzle is coupled with said reservoir and receives control signals from an electrical control circuit to dispense ink droplets according to user input.

76 Claims, 11 Drawing Sheets

INK JET MARKER

FIELD OF THE INVENTION

The present invention relates generally to the ink jet printing art, and in particular, to a hand-held marking device which utilizes an ink jet print-head in order to selectively apply ink to a print medium. Preferably, the print-head is part of a replaceable cartridge that may be replaced as desired.

BACKGROUND OF THE INVENTION

Various ink jet technologies that are utilized in conjunction with printer devices are known in the art. These generally include continuous feed ink jet systems and drop-on-demand systems. One such printer that is based on a drop-on-demand system utilizes a print-head that is disposed on a carriage. The carriage is translatable over a print medium. Relatively sophisticated electronics are employed including timing and encoding circuitry to move the print medium in a first direction and to move the carriage in an orthogonal direction thereto.

The print-head in these systems typically comprises a piezoelectric transducer, an ink chamber, and an ejection nozzle. The transducer is disposed to selectively vibrate the ink chamber in proximate relation to the ejection nozzle. In operation, a non-pressurized ink pulse jet is generated at a desired frequency, i.e., 1 to 10 kHz. The ink drops are generated on demand by a transient pressure pulse and directed toward a receiving surface. Volume changes in the ink chamber located behind the ink ejection nozzle cause the droplets to eject. These volume changes are generated by the piezoelectric transducer.

The impulse jets are relatively compact in design. Accordingly, print-heads based on this technology typically have arrays which include tens of nozzles operating synchronously.

Another technology which is known is the "bubble jet" or thermal jet printing technology. In these types of printers, a supply channel is provided which leads from an ink reservoir to one or a plurality of nozzles on an orifice plate. This supply channel is designed to provide a certain amount of resistance to flow. A thermo-electric transducer disposed proximate to the supply channel heats up the ink and produces a small vapor bubble. The vapor bubble drives the ink from the nozzle with a certain force. The maximum ejection frequency is approximately 4 kHz.

While these systems perform satisfactorily in printing capacities for which they are intended, it would be desirable to have a hand-held marking device based on these technologies.

SUMMARY OF THE INVENTION

Accordingly, it is an object of the invention to provide a hand-held marker that utilizes an ink jet technology.

It is a further object of the invention to provide an ink jet marker which is relatively simple in design and construction.

It is a further object of the invention to provide an ink jet marker which includes a replaceable cartridge that may be readily installed or removed from a marker body.

The present invention provides these and other additional objects and advantages in an ink jet marking device. The marking device comprises an elongated body of a generally cylindrical or other desired shape that is adapted for use as a writing instrument. A cartridge containing a reservoir of ink is disposed within the body. Preferably, the cartridge also comprises an ink jet print-head disposed at one end of the instrument body in fluid communication with the reservoir. The print-head includes at least one ejection nozzle adapted to dispense a selected amount of ink upon receipt of first control signals by the print-head. The marking device also comprises an electrical circuit coupled to the ink jet print-head disposed to provide the first control signals to the ink jet print-head.

In one embodiment, the electrical circuit is located in a base station console. The electrical circuit is connected to the print-head with electrical terminals. Alternatively, the electrical circuit is disposed within the cylindrical body of the marking device.

In another aspect of the invention, a replaceable ink cartridge is provided for insertion within a hand-held writing instrument body. The cartridge includes a print head and an enclosure containing a reservoir of ink adapted for placement within the body. At one end of the enclosure is an ink jet writing or print-head. The print-head includes a transducer, and an ejection nozzle coupled with the reservoir. The transducer is adapted to provide a disturbance that dispenses a selected amount of ink upon receipt of control signals provided by an electrical circuit. In one embodiment, a thin film battery is wrapped around the reservoir body.

DETAILED DESCRIPTION OF THE INVENTION

Generally, the present invention relates to a hand-held ink jet marker. The invention is relatively simple in design and construction, while being readily usable for a wide variety of marking or writing tasks. According to one feature of the invention, the marker includes a replaceable ink jet cartridge that may be readily installed into the marker.

Figure 1:
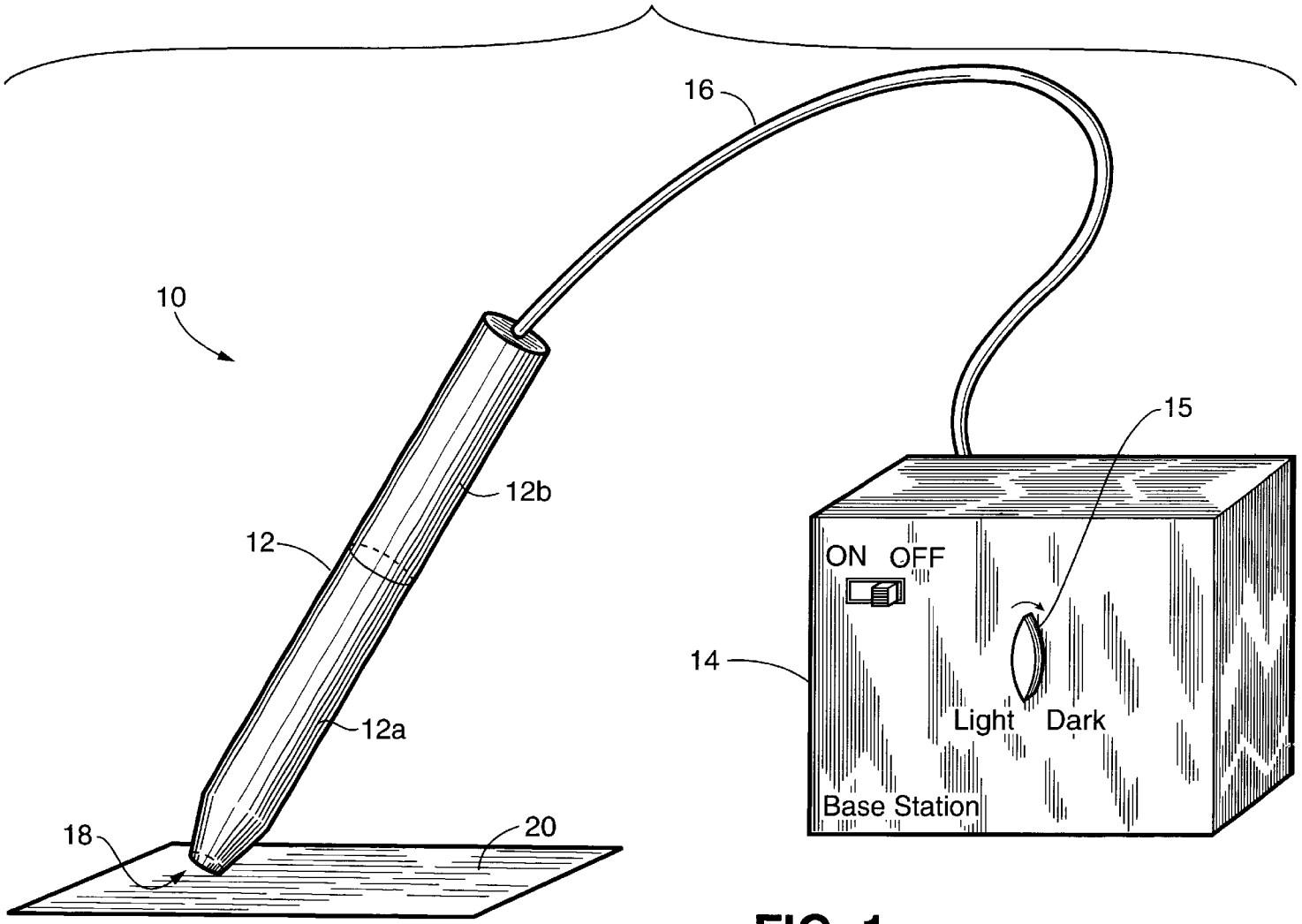
FIG. 1 is a perspective view of a writing instrument according to the present invention.

FIG. 1 illustrates an ink jet marker 10 according to one embodiment of the invention. The marker 10 comprises a longitudinally extending, generally cylindrical body or handle 12, a base station 14, and electrical connection terminals 16 disposed at one end of the body 12 that electrically connect the body 12 with the base station 14. While the embodiment shown in FIG. 1 is a cylindrical body, it may also be designed in other desired shapes, such as an oval shape or as an ergonomically designed body for ready hand manipulation. The opposite end of the body 12 contains a marking or print-head 18 disposed to receive a supply of ink from an ink reservoir (see FIG. 2). The body may be provided with cooperating first and second pieces 12*a* and 12*b* that are connected with threads as will be understood by those skilled in the art.

The print-head 18 is electrically coupled with the control station 14 and, in response to control signals received therefrom, selectively ejects a stream or predetermined pattern of ink droplets onto a writing or print medium 20. The embodiment shown is a single nozzle ink jet writing device. This arrangement provides a unique and unobvious arrangement that is suitable for many applications.

Figure 2:
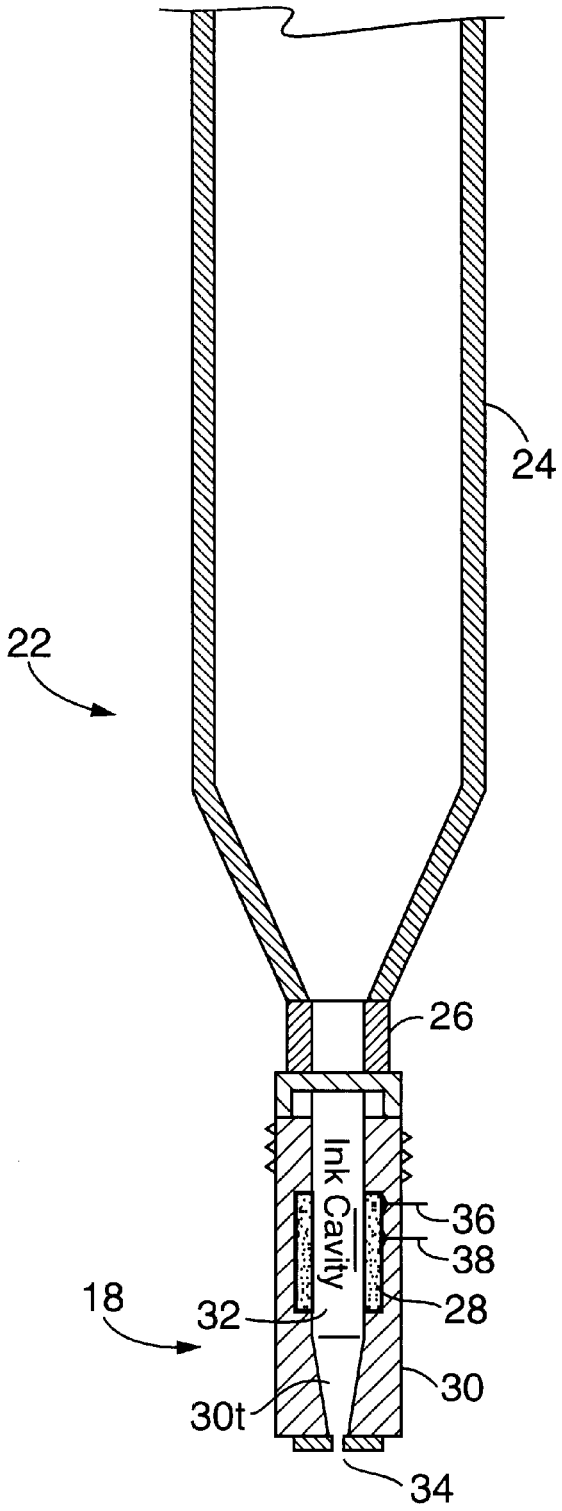
FIG. 2 illustrates an enlarged cross section view of a cartridge including an ink reservoir and a print-head of one embodiment of the writing instrument shown in FIG. 1.

FIG. 2 shows in cross section the details of an ink jet cartridge 22 which may be utilized in the writing instrument 10 of FIG. 1. The cartridge 22 comprises the print-head 18, an elongated ink reservoir 24 and a flexible connecting hose 26 disposed between the print-head 18 and the reservoir 24.

One important advantage of one embodiment of the invention is that the ink jet cartridge 22 is provided as a replaceable unit. In this regard, the cartridge 22 is insertable into the body 12 and secured thereto via suitable connection means such as threads.

The details of the print-head 18 fabricated in accordance with one embodiment of the invention are also shown in FIG. 2. The print-head 18 comprises a cylindrical piezoelectric driver element 28 disposed in an annular print-head housing 30. The housing 30 forms an ejection nozzle including an ink cavity 32 in proximate relation to the driver element 28. The ink cavity 24 is coupled with the ink reservoir 24 via the flexible hose 26 disposed at one end of the housing 30. The housing 30 includes a tapered section 30*t* at its opposite end. As described below, the tapered section 30*t* is configured to smooth out the ink flow which will form a droplet. An orifice or ejection nozzle 34 is located at the distal end of the housing 30.

The piezoelectric driver element 28 is a transducer that receives electric signals from a pair of conductors 36, 38. In response, the driver element 28 selectively applies pressure pulses to the ink drawn into the ink cavity 32 as desired. Such application of pressure pulses accelerates the ink toward the nozzle end of the cavity. An ink droplet of a diameter comparable to that of the orifice 34 will be formed when the impulse of the ink pressure wave exceeds the surface tension of the meniscus at the orifice. In one embodiment, ink droplets may be ejected with a velocity of between 2–20 m/s.

Inasmuch as the volume change of the piezoelectric transducer 28 increases linearly with the applied voltage, the volume or mass of a generated ink droplet is also proportional to the applied voltage. In one embodiment, the impulse amplitude is sufficiently large, on the order of 60 volts.

Figure 3A:
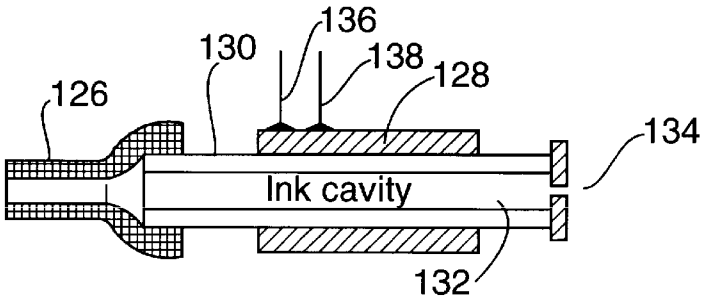
FIGS. 3A and 3B are cross-sectional or cut-away views which illustrate other forms of a print-head which may be used in conjunction with the invention.
Figure 3B:
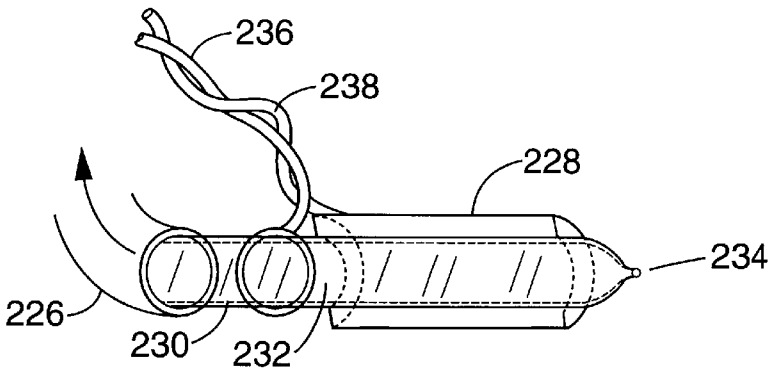

FIG. 3A and FIG. 3B illustrate slight variations of the print-head configuration shown in FIG. 2. FIG. 3A is a cross section showing an ink cavity 132 defined by a generally cylindrical capillary tube 130. A fluid connection hose 126 is coupled with one end of the housing 130 and to an ink supply. An orifice 134 is disposed at the distal end of the housing. A transducer element 128 is disposed in surrounding relation with respect to the ink cavity 132 and is connected to terminals 136, 138.

Similarly, FIG. 3B shows a cylindrical ink cavity 232 defined by a capillary tubular housing 230. A flexible hose 226 is likewise coupled with one end of the tubular housing 230 and to an ink supply. As with the embodiment shown in FIG. 2, the housing 230 is likewise tapered at its distal end to smooth out the ink flow forming a droplet and terminates to define an orifice 234. A transducer element 228 is disposed in surrounding relation with respect to the ink cavity 232 and is connected to terminals 236, 238.

Figure 4:
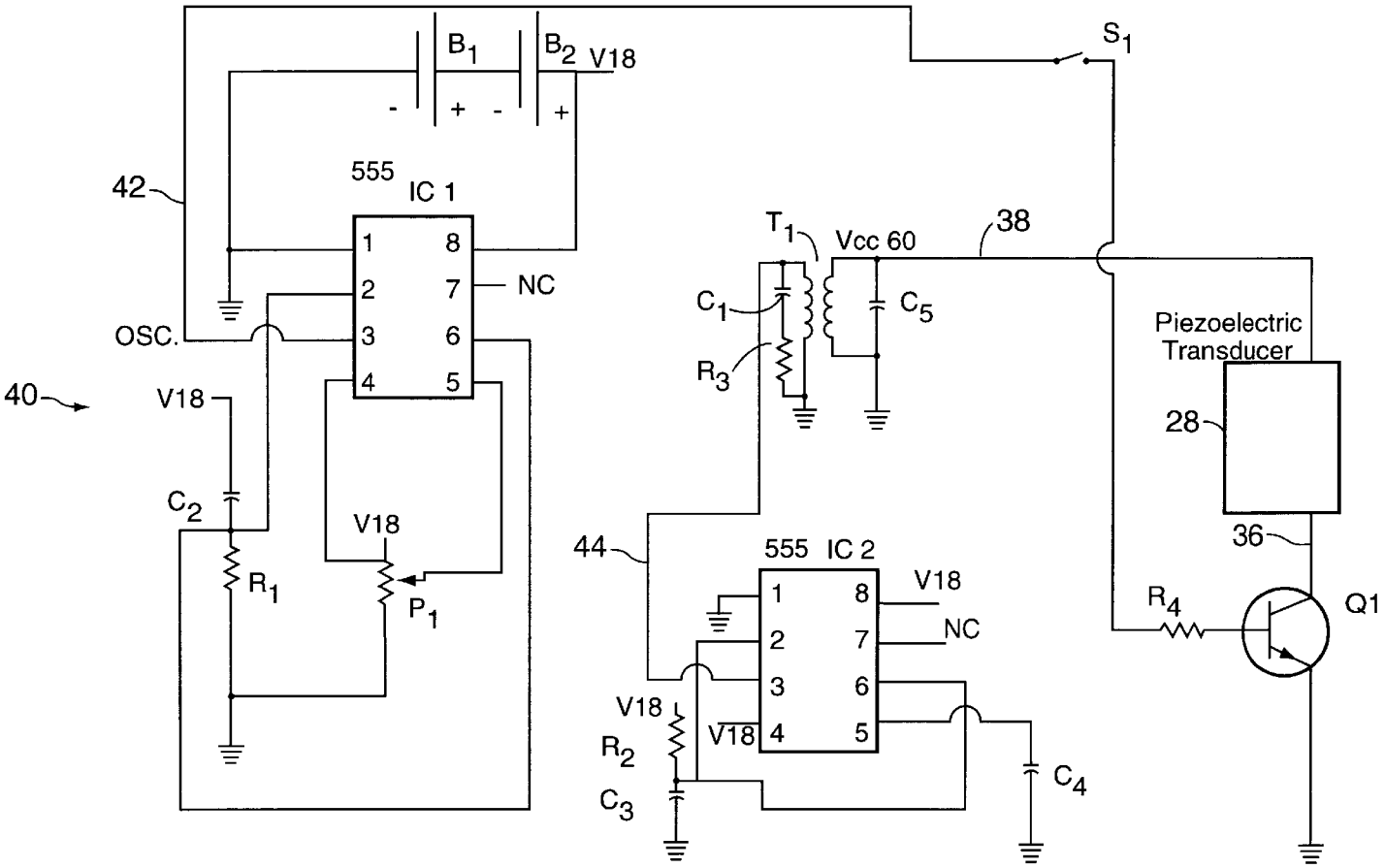
FIG. 4 is a simplified electrical schematic diagram suitable for providing control signals to the print-head shown in FIGS. 2, 3A or 3B.

FIG. 4 is a simplified circuit diagram of a circuit 40 suitable for driving the piezoelectric print-head 18 shown in FIG. 2. The circuit 40 includes a pair of integrated circuit timers IC1 and IC2. In one embodiment, timers IC1 and IC2 are type IC 555 linear timer circuits having a pin configuration that is well known. Timer IC1 has its terminals connected to operate in an astable mode as an oscillator. Accordingly, IC1 provides a clock signal at its output denoted by a line 42. In this regard, a potentiometer P1 is connected to the trigger level threshold input terminal of timer IC1 to vary the frequency of oscillation of timer IC1. Optionally, the potentiometer P1 may be adjusted by the control knob 15 shown in FIG. 1 to adjust the intensity of the resulting ink dispersion.

The output signal on the line 42 is supplied through a switch S1 and a resistor R4 to the base terminal of a transistor Q1. The collector terminal of transistor Q1 is connected to one of the terminals of the piezoelectric transducer 28 on the line 36. The emitter terminal of the transistor Q1 is connected to ground. Accordingly, when the switch S1 is closed, an oscillating signal is provided to the transducer element 28.

The ink jet droplets are preferably formed upon the application of voltage output levels of between 50 to 200 volts. In this regard, a pair of alkaline batteries B1 and B2 are used to provide a constant voltage of about 18 V DC. Of course, other voltage sources such as a 5 volt or 12 volt source may be utilized with appropriate modification. This DC voltage is applied to the second timer IC2. The second timer IC2 is used as a pulse width modulator for adjusting the voltage signal provided to the transducer element 28 and thereby control the ink-jet dispersion. In this regard, the second timer IC2 transforms the received voltage into a pulsed output signal on a line 44 having a frequency of about 400 Hz in one embodiment. The signal on the line 44 is applied to the primary winding of a step-up transformer T1. In one embodiment, the transformer T1 has a turns ratio of 1-to-3. The output of the secondary winding of transformer T1 is thus about 54 volts. This output is supplied via the line 38 to the transducer element 28. Inasmuch as the signal shape and timing are important aspects for proper functioning of the piezoelectric transducer element, low capacitance cabling is preferably utilized to link the marker with the base station.

FIG. 4 also shows a snubber capacitor C1 having one of its terminals connected to the primary winding of the transformer T1. The second terminal of the snubber capacitor C1 is connected through a resistor R3 to ground. This arrangement protects the output of the second timer IC2. A filter capacitor C5 is connected between the terminals of the secondary winding of transformer T1 and is used to provide a filtered 54 V DC signal. The second IC timer IC2 can supply sufficient current (i.e., 200 mA) in order to drive multiple ejection nozzles, as is explained in greater detail below.

Figure 5:
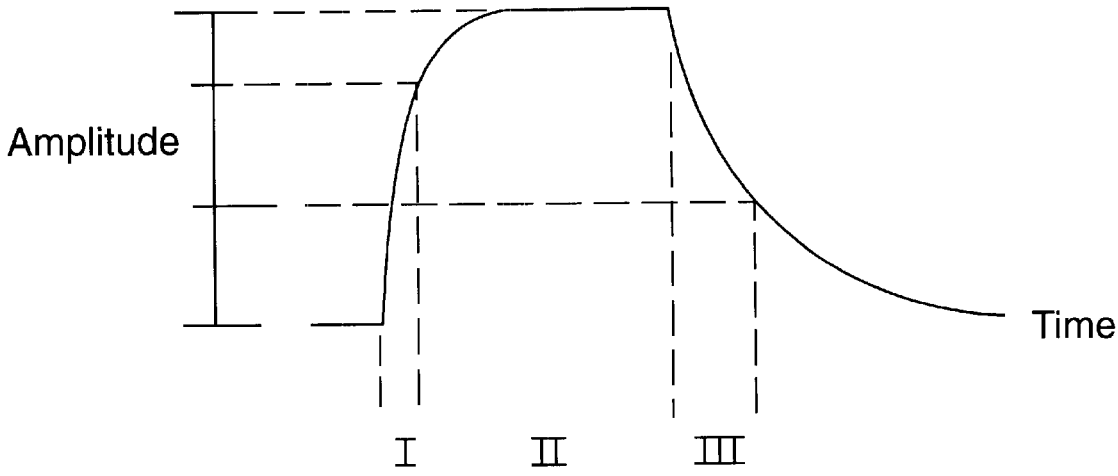
FIG. 5. is an output waveform of a signal provided by the circuit shown in FIG. 4.

The drop formation mechanism can be described with respect to three segments of an electrical voltage pulse applied by the control circuit 40 to the transducer element 28, as shown in FIG. 5. In Segment I, the ink in the meniscus disposed within the ink cavity or chamber 32 is initially substantially at rest. An electric pulse such as that shown in FIG. 5 is then applied to excite the peizo-electric transducer 28. A relatively short rise time in the applied voltage induces a contraction of the tubular housing 30 which results in a pressure increase within the ink chamber 32.

As a result of the excitation and the resulting pressure increase, the ink flows in opposite directions: toward the ejection orifice 34 which bulges out the ink at the meniscus; and, toward the ink supply line 26. In this regard, the flexible ink hose 26, connecting the ink cavity 32 with the reservoir 24, tends to absorb the pressure wave propagation towards the reservoir. This tends to minimize pressure wave reflection of the ink, which could otherwise interfere with the droplet ejection at the orifice 34.

In Segment II, the input voltage pulse has achieved its peak value, i.e., approximately 60 volts. The ink continues to accelerate and reaches a maximum velocity, nearly twice the velocity of the resulting droplet. The separation of an ink droplet from the ink in the meniscus occurs in the relatively short dwell mode during Segment II.

In a next Segment III, the input voltage is decreased. The resulting surface tension forces reduce the ink flow and eventually reverse the ink flow. In particular, the input voltage decrease causes a compression of the ink chamber 32 and a negative pressure at the orifice 34. The ink reverses flow from both the orifice 34 and ink supply 26 toward the center of the ink chamber 32 and the meniscus becomes concave.

Eventually, the lost ink due to the ejected droplet is refilled by capillary action in the ink chamber 32. In the case of an orifice diameter of about 50 to 80 microns with an effective length of the meniscus at the orifice during refill of about 0.9–1.3 mm and a surface tension of the ink of about 40–50 dynes/cm, the resulting upper frequency of dispersion of ink droplets is about 10 kHz.

Figure 6:
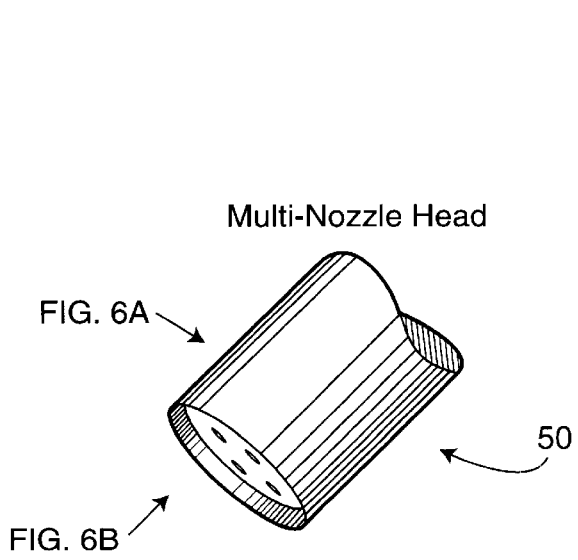
FIG. 6 is a perspective view illustrating a print-head with multiple ejection nozzles according to another embodiment of the invention.
Figure 6A:
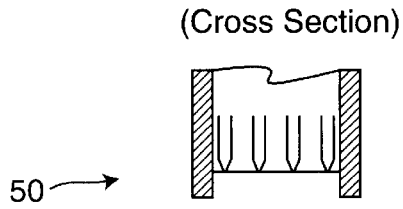
FIG. 6A is a cross-sectional view of the print-head with multiple ejection nozzles taken along the lines 6A—6A shown in FIG. 6.
Figure 6B:
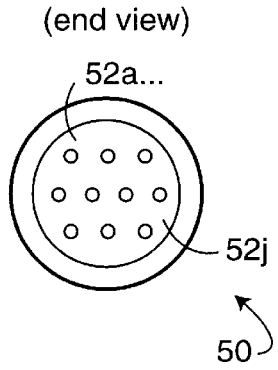
FIG. 6B is a bottom view of the print-head with multiple ejection nozzles shown in FIG. 6.

FIG. 6, FIG. 6A and FIG. 6B illustrate a different print-head 50 according. to another embodiment of the present invention. In this embodiment, a multiplicity of ejection nozzles or orifices are employed such as orifices 52*a*–52*j* shown in FIG. 6B. The plurality of orifices are relatively closely spaced from each other, i.e., within a few microns apart, and are arranged in a preselected bank or pattern as shown in FIG. 6B. In this embodiment, each of the plurality of orifices has an associated transducer element such as element 28 shown in FIG. 2 associated therewith. This arrangement permits a pattern to be generated on a print medium upon selective actuation of the transducer elements.

The circuit 40 shown in FIG. 4 may be employed to provide control signals to each of the ejection nozzles 52*a* through 52*j*. The resulting dispersion of ink to the print medium will be of a greater intensity than the pattern generated by one ejection nozzle.

Figure 7:
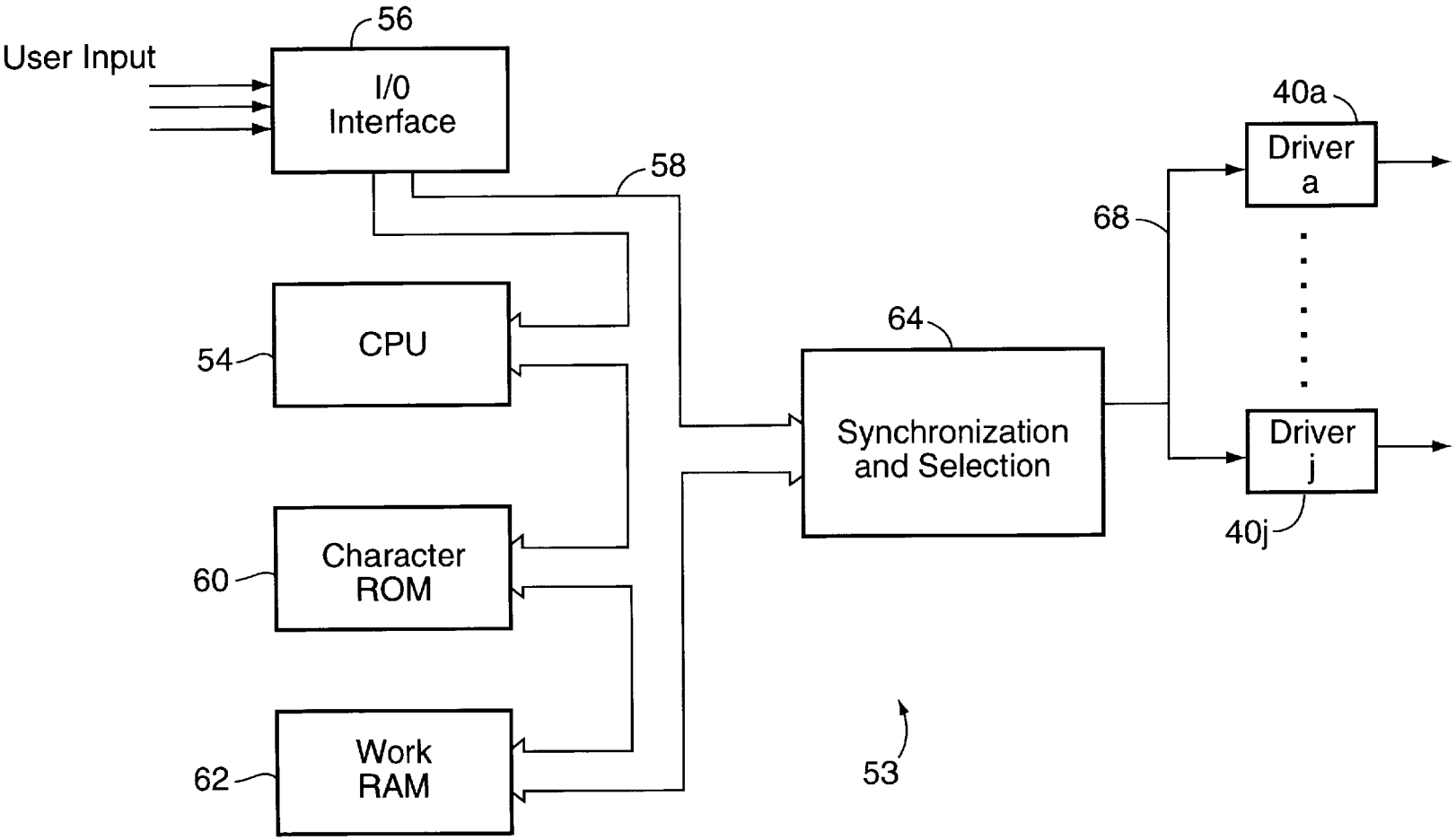
FIG. 7 illustrates a simplified block diagram of control circuitry for a writing instrument print-head made in accordance with FIG. 6, FIG. 6A and FIG. 6B.

Alternatively, suitable control circuitry may be employed to selectively actuate one or more of the ejection orifices. This may be utilized to create random patterns on the print medium or even generation of characters or the like with appropriate modification. By way of example, the patterns may comprise traditional symbols such as stars, squares or other geometric shapes or they may be other characters such as those that are popular with children. FIG. 7 shows a simplified block diagram representation of a control circuit 53 which may be employed. The control circuit 53 provides output signals to selectively actuate the respective ejection nozzles in the print-head 50 shown in FIG. 6. This embodiment utilizes a microprocessor or CPU 54 in conjunction with appropriate circuitry to generate control signals that are applied to a plurality of piezo-driver circuits 40*a* through 40*j*. For example, the driver circuits 40*a* through 40*j* may be functionally the same as circuit 40 described above in conjunction with FIG. 4.

In operation, the CPU 54 receives digital input signals from I/O Interface circuitry 56 via a bus 58. These signals are based on user input and selection. Based on this information, the CPU 54 accesses data contained in a Character ROM 60. The Character ROM 60 contains a library of patterns and/or characters that may be built or accessed by the CPU 54. The CPU 54 performs logical operations with data contained in the Character ROM 60 in conjunction with a Work RAM 62 and provides control data to a Synchronization and Selection circuit 64. This circuit 64 provides appropriate output signals on a line 68 to the plurality of driver circuits 40*a* through 40*n;* in this way various characters may be generated on the print medium.

The control circuit 53 may optionally receive input signals corresponding to the horizontal and vertical positions and movement of the marking device and of the print-head 50. For example, the I/O circuitry 56 may receive input signals from a track-ball or other device providing indicators of the positioning and movement of the marking device. This data is utilized by the CPU 54 and the synchronization and selection circuitry 64 to adjust the output provided to the respective driver circuits 40*a* through 40*j*. In addition, the control circuit 53 may receive signals from a contact switch or other suitable device located on the body 12 that provides an indication of when the body is in contact with the print medium or when the print-head 50 is in close relation with the print medium. This provides an additional safety feature that prevents unintended dispersion of ink from the marking device.

Figure 8:
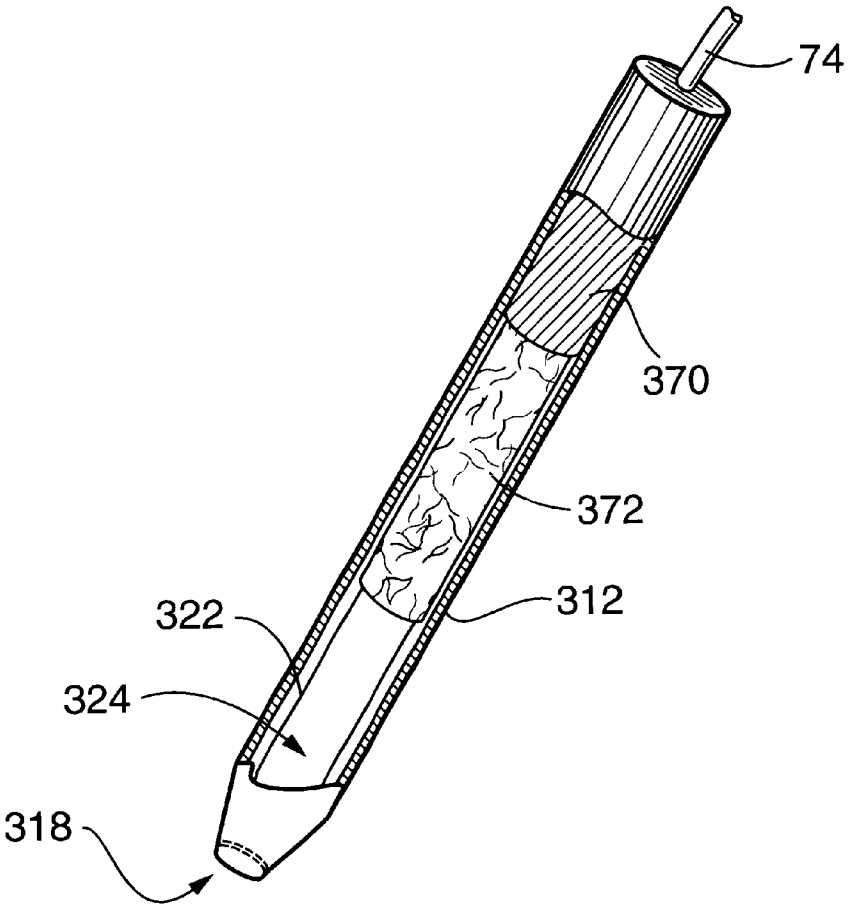
FIG. 8 is a partially cutaway perspective view of yet another embodiment of the present invention.

FIG. 8 illustrates a perspective view of yet another embodiment of the present invention with portions of the marking instrument body 312 removed for clarity. In this embodiment, a control circuit package 370 is designed for placement within the body 312 of the writing instrument. By way of example, the control circuit package 370 may contain circuitry to perform the functionality of the circuit 40 shown in FIG. 4 or the circuit 53 shown in FIG. 7. FIG. 8 also shows the ink cartridge 322 located within the cavity provided within the marker body 312 in abutting relation with the control circuit package 370. In this embodiment, the ink cartridge 322 is provided as a replaceable unit that includes the print-head 318, the ink reservoir 324, and a thin film battery 372 disposed in surrounding relation with respect to the ink reservoir 324. Suitable electrical contacts are provided to connect the battery 372 with the circuit elements within the control circuit package 370 and to connect the output terminals of the control circuit package 370 with the print-head 318.

In order to interfit within the cavity, the plurality of the elements in the electrical circuit package 370 may be provided as an integrated circuit package with appropriate modification. The circuit package is operable with the use of a pushbutton switch 74 preferably disposed at one end of the marker body 312. This structure provides a very compact design although the design may tend to increase the cost of manufacture of the marker.

Figure 9:
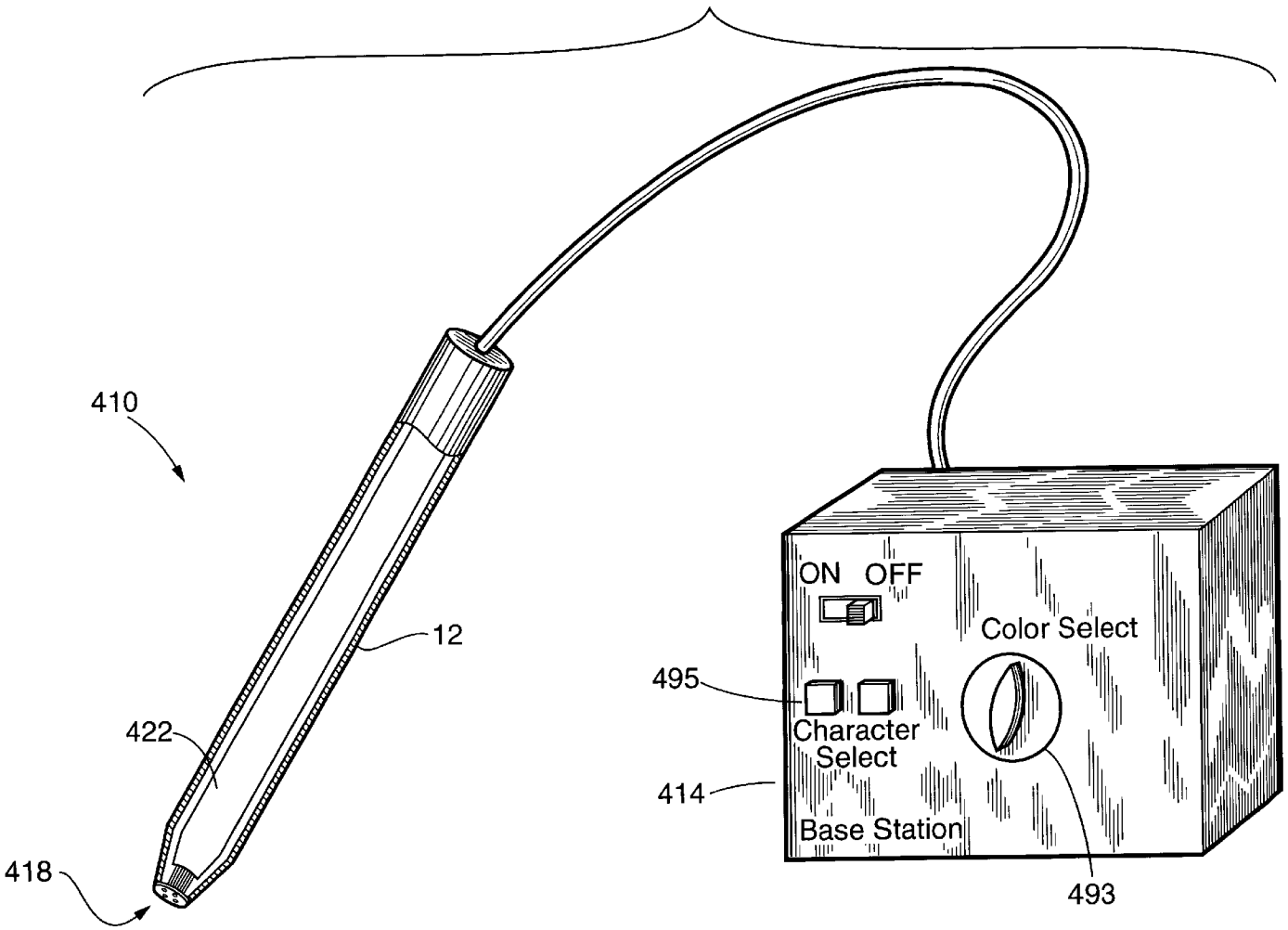
FIG. 9 is a partially cutaway view of an embodiment of the present invention that is constructed to generate color printing.

FIG. 9 is yet another modification of the invention. In this embodiment, a color ink jet marking device 410 is shown that comprises a print-head 418 is equipped with one or more nozzles that eject yellow, cyan, magenta and black colors. By varying the controls provided on a base station 414, the marker 410 selects an appropriate mix of the primary colors to eject to the print medium. FIG. 9 also illustrates an ink cartridge 422 that is separated into four quadrants containing ink reservoirs corresponding to the yellow, cyan, magenta and black colors. These reservoirs are in fluid communication with the respective ejection nozzles located on the print-head 418 in a manner described above.

Figure 10:
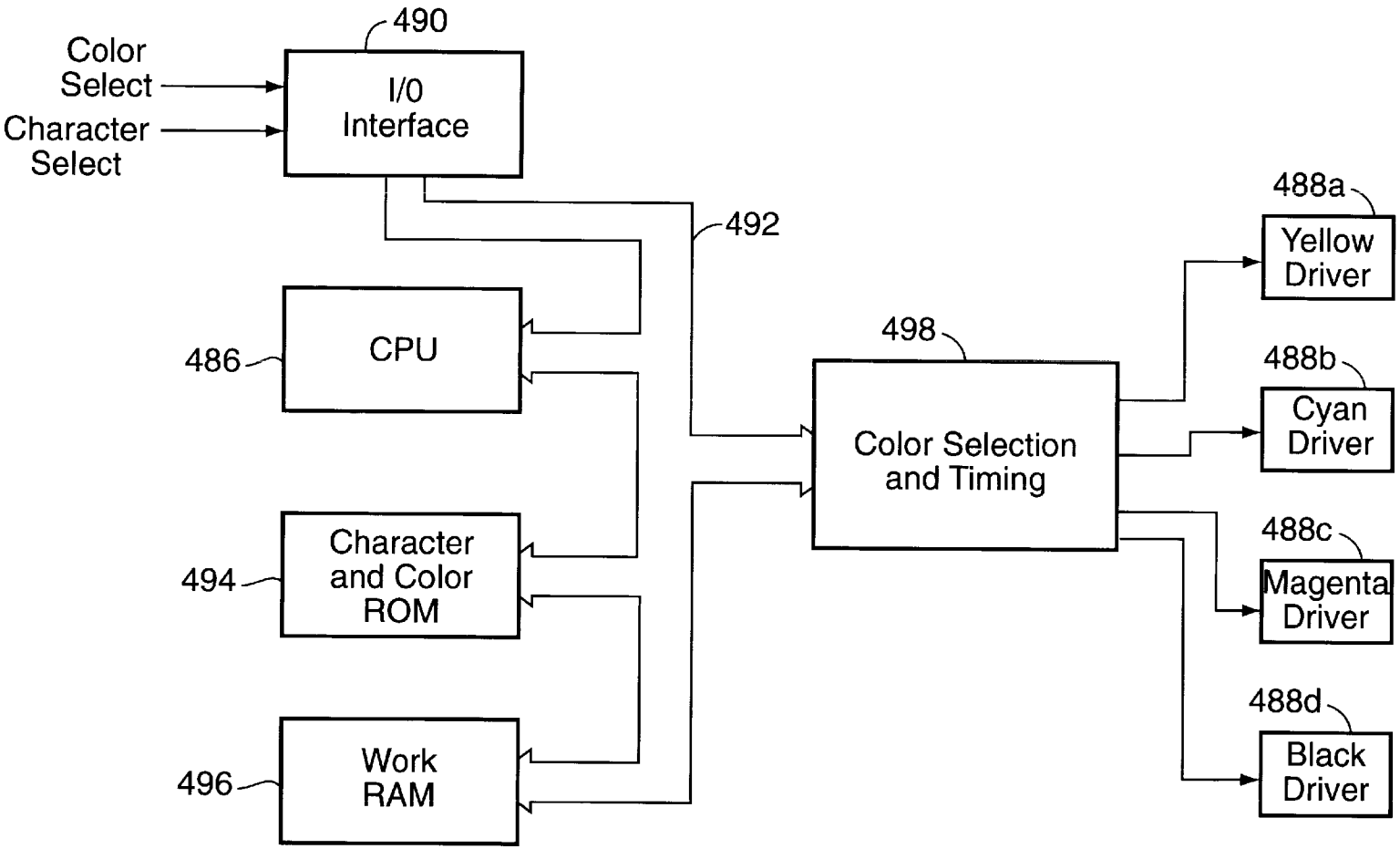
FIG. 10 illustrates a simplified block diagram of control circuitry for a writing instrument print-head made in accordance with FIG. 9.

FIG. 10 illustrates a simplified block diagram representation of control circuitry suitable for providing signals to the print-head 418 in the embodiment of FIG. 9. In this exemplary circuit construction, a microprocessor CPU 486 in conjunction with appropriate circuitry generates voltage regulated output signals that are applied to a plurality of driver circuits 488*a* through 488*d*. For example, the driver circuits 488*a* through 488*d* may be functionally the same as the circuit 40 described above in conjunction with FIG. 4. The CPU 486 receives digital input signals from I/O Interface circuitry 490 via a bus 492. These signals correspond to the desired color to be created on the print medium and are based on user selection of a control knob 493 or other suitable input device located on the base station 414 (see FIG. 9). In addition, the user may select desired patterns and/or characters with the use of input buttons 495.

Based on this information, the CPU 486 accesses data contained in a Character ROM 494. In addition to patterns and/or characters, the ROM 494 may include a look-up table corresponding with the selected color. The CPU 486 performs logical operations with data contained in the Character ROM 494 in conjunction with a Work RAM 496 and provides control data to a Color Selection and Timing circuit 498. This circuit 498 provides appropriate output signals to the plurality of color driver circuits 488*a* through 488*d*. In this way, the size and duration of pulses applied to the respective ejection nozzles is varied to provide a desired color. The ink droplets are ejected onto the print medium in very close relation with each other so that the color perceived by the user is the additive colors ejected.

Figure 11:
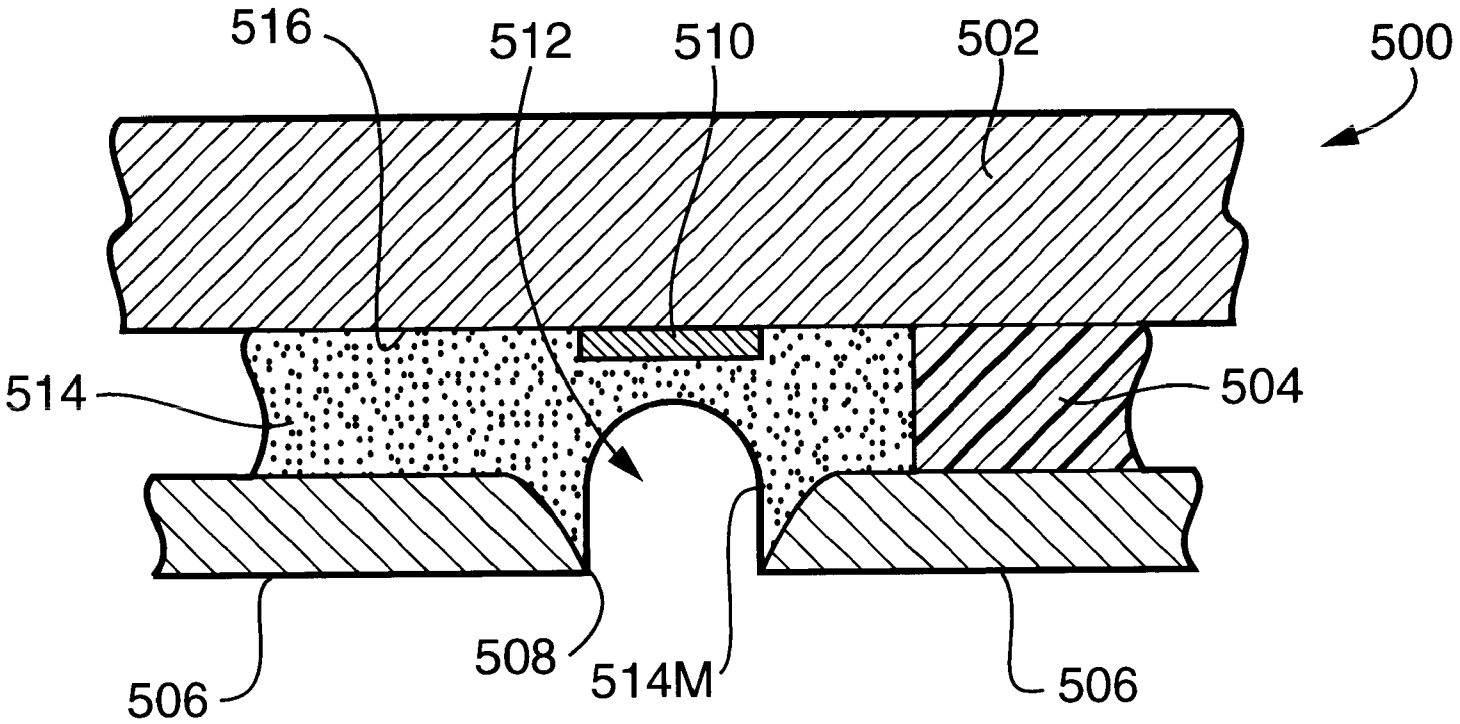
FIG. 11 is a cross-sectional view of a portion of a print-head made in accordance with another embodiment of the present invention.

Although embodiments of the invention are described herein in conjunction with a print-head that employs one or more ejection nozzles that utilize a vibratory element to generate ink droplets, it should be understood that the invention is not limited thereto. FIG. 11 illustrates a portion of a print-head 500 made in accordance with another embodiment of the present invention. The print-head 500 comprises a substrate 502, a barrier layer 504, and an orifice plate 506. The orifice plate 506 includes an opening or nozzle 508 disposed therein. The nozzle 508 is positioned in spaced relation from a thermal heating element 510 such as a resistor element. This area is sometimes known as a firing chamber 512. The orifice plate 506 typically includes a plurality of nozzles located therein, each of which is operatively associated with a resistor. For example, the orifice plate may be provided with a matrix of approximately 128 nozzles per ¼ square inches in the print-head.

In operation, ink denoted by the numeral 514 fills an ink feed channel 516. The feed channel provides ink proximate to each orifice such as orifice 508. The channel 514 is defined by the substrate 502, the barrier layer 504, and the orifice plate 506. The ink forms a meniscus denoted by numeral 514*m* following a drop ejection.

Each resistor such as resistor 510 is connected by an electrically conductive trace to a current source. The current source receives control signals from a control circuit or a computer. The control circuit provides appropriate signals so that current pulses are applied to selected resistors 510. When the current is applied to the resistor, the resistor generates heat. The generation of heat causes the ink in the firing chamber 512 to nucleate and expand. As a result, a droplet of ink is expelled through the nozzle 508 and onto the print medium. Ink is then drawn into the feed channel through capillary action.

The circuitry described above in conjunction with FIGS. 7 and 10 can be readily be modified in order to provide appropriate current pulses to the heater-resistors disposed in the print-head 500. In this way, the desired colors and/or patterns and intensity of the marking device may be provided. Additional details of operation in the context of thermal ink-jet printers are described in, for example, *Hewlett-Packard Journal,* Vol. 36, No. 5, May 1985, the subject matter of which is incorporated by reference.

The type of ink utilized in conjunction with the present invention is non-toxic, washable and non-flammable. The ink characteristics should also provide appropriate surface tension and density, while minimizing clogging and gas bubble formation. In this regard, a water-based ink provides an optimal surface tension comparable to the value of 76 dynes/cm obtained for water alone. The ink is also pH controlled in order to prevent shifting of the color of the dyes and corrosion of the print-head components.

Accordingly, an ink jet marker meeting the aforestated objectives has been described. The marker provides an easy-to-use writing instrument which is relatively simple in construction and design, while being quite versatile in operation. Of course, those skilled in the art will understand that other modifications may be incorporated, particularly upon consideration of the foregoing teachings. For example, the marking device may be provided as a peripheral device which is connectable to a personal computer with the inclusion of appropriate interface circuitry and software. Accordingly, the invention is intended to be covered by the appended claims, which are made part of this disclosure.

What is claimed is:

1. A multiple color ink jet marker comprising:

an elongate hand-held writing instrument body;

a removable cartridge, said cartridge including an ink jet print-head and a reservoir of ink provided as a unitary structure, said ink jet print-head disposed at one end of said instrument body in fluid communication with said reservoir when said cartridge is inserted into said instrument body, said ink jet print-head having a plurality of ejection nozzles in fluid communication with said ink reservoir, wherein desired ones of said ejection nozzles dispense a selected amount of ink of a first color upon receipt of first control signals and wherein other ones of said ejection nozzles dispense a selected amount of ink of a second color upon receipt of second control signals;

at least one color input control providing ready hand access to a user; and an electrical circuit coupled to said ink jet print-head and said at least one input control including synchronization and selection circuit means for generating said first and second control signals to expel droplets of ink of said first and second colors in response to the receipt of input signals from said at least one input control, said ink droplets rendering a pattern of ink that is perceptible as a conventional marker to the user.

2. The ink jet marker as in claim 1 wherein said electrical circuit is disposed within said writing instrument body.

3. The ink jet marker as in claim 1 wherein said electrical circuit is disposed at a remote location from said body.

4. The ink jet marker as in claim 3 wherein said electrical circuit and said print-head are connected via electrical wiring.

5. The ink jet marker as in claim 1 wherein at least one of said ejection nozzles comprises an ejection orifice, an ink chamber in fluid communication with said reservoir, and a transducer element disposed in proximate relation to said ejection orifice, said transducer element receiving said first control signals and vibrating said ink chamber to eject droplets of ink from said ejection orifice.

6. The ink jet marker as in claim 1 wherein said ejection nozzles are in fluid communication with a plurality of ink reservoirs disposed in said cartridge.

7. The ink jet marker as in claim 6 wherein said electrical circuit synchronization and selection circuit means further applies control signals to desired ones of said ejection nozzles in response to user input concerning a desired pattern.

8. The ink jet marker as in claim 1 wherein said print head includes:

at least one heater element, said heater element being disposed in a firing chamber supplied with ink from said ink reservoir, and a nozzle member including at least one nozzle associated with said heater element, through which droplets of ink are expelled toward said print medium when said heater element is actuated.

9. The ink jet marker as in claim 1 wherein said circuit means applies control signals to desired ones of said ejection nozzles in response to user input concerning a desired color.

10. An ink jet marker comprising:

a longitudinally extending writing instrument body defining an inner cavity;

a replaceable cartridge disposed in said inner cavity and extending substantially the lengthwise dimension of said body, said cartridge including a plurality of ink reservoirs and an ink jet writing head fluidically coupled with and attached to said each of said reservoirs to form a unit that may be removed from said writing instrument body, said ink jet writing head dispensing a selected amount of ink of a plurality of colors upon receipt of control signals;

electrical control circuit means including a color selection input for providing said control signals based on selection by a user; and electrical terminals coupling said electrical control circuit with said ink jet writing head.

11. The ink jet marker as in claim 10 wherein said writing head includes a plurality of ejection orifices, each orifice coupled with an ink chamber in fluid communication with said reservoir, and a transducer element disposed in proximate relation to at least one of the ejection orifices, said transducer element receiving said plurality of control signals and vibrating said ink chamber to eject droplets of ink from each of said ejection orifices.

12. The ink jet marker as in claim 11 wherein said electrical control circuit means further comprises selection means disposed to select desired ones of said transducer elements.

13. A replaceable cartridge for use in a hand held ink jet writing instrument including a generally cylindrical writing instrument body with an opening at one end and an electrical circuit disposed to provide a plurality of control signals, said cartridge comprising:

an enclosure containing a first reservoir of ink and a second reservoir adapted for placement within the writing instrument body;

an ink jet printing head including at least one ejection nozzle being in fluid communication with said first reservoir and being positioned in said body such that said at least one ejection nozzle extends through said opening to dispense a selected amount of ink upon receipt of said control signals; and an electrical interconnect arrangement disposed to connect said ink jet printing head with the electrical circuit, said enclosure, said ink jet printing head and said electrical interconnect arrangement all provided as a single replaceable unit.

14. The replaceable cartridge as in claim 13 wherein said printing head further comprises a transducer element coupled with said electrical interconnect arrangement, an ink chamber in spaced relation from said transducer element, and an ejection orifice disposed at one end of said ink chamber, said ink chamber being in fluid communication with said reservoir and dispensing a selected amount of ink through said ejection orifice upon receipt of said control signals by said transducer element.

15. The replaceable cartridge as in claim 14 wherein said ink chamber is generally cylindrical and wherein said transducer element is disposed in surrounding relation to said ink chamber.

16. The replaceable cartridge as in claim 13 wherein said printing head comprises a plurality of spaced ejection nozzles each of which is in fluid communication with said ink reservoir.

17. The replaceable cartridge as in claim 16 wherein each of said ejection nozzles comprises an ink chamber, an ejection orifice, a transducer element.

18. The replaceable cartridge as in claim 13 wherein said first ink reservoir contains a single color of ink.

19. The replaceable cartridge as in claim 13 further comprising a flexible hose connected between said enclosure and said printing head providing fluid communication therebetween.

20. The replaceable cartridge as in claim 13 wherein said ink jet print head further includes a second ejection nozzle coupled with said second reservoir of ink, each of said ejection nozzles dispensing a selected amount of ink upon receipt of said control signals.

21. The replaceable cartridge as in claim 20 wherein said first ink is of a first color and said second ink is of a second color.

22. The replaceable cartridge as in claim 21 wherein said enclosure further includes a third reservoir of a third ink and wherein said print head includes a third ejection nozzle coupled with said third reservoir of ink and dispensing a selected amount of ink upon receipt of said control signals.

23. The replaceable cartridge as in claim 22 wherein said third ink is of a third color.

24. The replaceable cartridge as in claim 13 wherein said print head includes:

at least one heater element, said heater element being disposed in a firing chamber supplied with ink from said ink reservoir, and a nozzle member including at least one nozzle associated with said heater element, through which droplets of ink are expelled toward said print medium when said heater element is actuated.

25. A replaceable cartridge for use in a hand held ink jet writing instrument including a writing instrument body and an electrical circuit disposed to provide a plurality of control signals, said cartridge comprising:

an enclosure containing a reservoir of ink adapted for placement within the writing instrument body;

an ink jet printing head including at least one ejection nozzle being in fluid communication with said reservoir and adapted to dispense a selected amount of ink upon receipt of said control signals;

a power supply; and an electrical interconnect arrangement disposed to connect said ink jet printing head and said power supply with the electrical circuit, said enclosure, said ink jet printing head, said power supply and said electrical interconnect arrangement all provided as a replaceable unit.

26. The invention as in claim 25 wherein said power supply comprises a thin-film battery disposed in surrounding relation to said enclosure.

27. The replaceable cartridge as in claim 25 wherein said ink jet printing head further comprises a transducer element coupled with said electrical interconnect arrangement, an ink chamber in spaced relation from said transducer element, and an ejection orifice disposed at one end of said ink chamber, said ink chamber being in fluid communication with said reservoir and dispensing a selected amount of ink through said ejection orifice upon receipt of said control signals by said transducer element.

28. The replaceable cartridge as in claim 27 wherein said ink chamber is generally cylindrical and wherein said transducer element is disposed in surrounding relation to said ink chamber.

29. The replaceable cartridge as in claim 25 wherein said ink jet printing head comprises a plurality of spaced ejection nozzles each of which is in fluid communication with said ink reservoir.

30. The replaceable cartridge as in claim 29 wherein each of said ejection nozzles comprises an ink chamber, an ejection orifice, and a transducer element.

31. The replaceable cartridge as in claim 25 wherein said reservoir contains a single color of ink.

32. The replaceable cartridge as in claim 25 further comprising a flexible hose connected between said enclosure and said ink jet printing head providing fluid communication therebetween.

33. The replaceable cartridge as in claim 25 wherein said ink jet printing head further includes a second ejection nozzle coupled with a second reservoir of a second ink, each of said ejection nozzles dispensing a selected amount of ink upon receipt of said control signals.

34. The replaceable cartridge as in claim 33 wherein said ink is of a first color and said second ink is of a second color.

35. The replaceable cartridge as in claim 34 wherein said enclosure further includes a third reservoir of a third ink and wherein said ink jet printing head includes a third ejection nozzle coupled with said third reservoir of ink and being adapted to dispense a selected amount of ink upon receipt of said control signals.

36. The replaceable cartridge as in claim 35 wherein said third ink is of a third color.

37. The replaceable cartridge as in claim 25 wherein said ink jet printing head includes:

at least one heater element, said heater element being disposed in a firing chamber supplied with ink from said ink reservoir.

38. The replaceable cartridge as in claim 25 wherein said control signals are applied to desired ones of said ejection nozzles in response to user input concerning a desired color.

39. An ink jet marker comprising:

an hand-held writing instrument body;

a cartridge containing a plurality of reservoirs of ink disposed in said body, each of said reservoirs containing ink of a different color;

said cartridge further including an ink jet print-head disposed at one end of said instrument body when said cartridge is inserted into said writing instrument body, said print-head including a plurality of ejection nozzles, each of which is in fluid communication with a corresponding one of said reservoirs and adapted to dispense a selected amount of ink upon receipt of control signals; and an electrical circuit coupled to said ink jet print-head disposed to provide said control signals to expel droplets of ink through desired ones of said ink jet print-head nozzles, said droplets of ink providing a pattern that is perceptible as a conventional marker.

40. The ink jet marker as in claim 39 wherein said electrical circuit is disposed within said writing instrument body.

41. The ink jet marker as in claim 39 wherein said electrical circuit is disposed at a remote location from said body.

42. The ink jet marker as in claim 39 wherein said electrical circuit and said print-head are connected via electrical wiring.

43. The ink jet marker as in claim 39 wherein said electrical circuit includes synchronization and selection circuit means and applies control signals to desired ones of said ejection nozzles in response to user input concerning a desired pattern.

44. The ink jet marker as in claim 39 wherein said ink jet print-head includes:

at least one heater element, said heater element being disposed in a firing chamber supplied with ink, and a nozzle member including at least one nozzle associated with said heater element, through which droplets of ink are expelled toward said print medium when said heater element is actuated.

45. The ink jet marker as in claim 39 wherein said ink jet printing head further comprises a transducer element, an ink chamber in spaced relation from said transducer element, and an ejection orifice disposed at one end of said ink chamber, said ink chamber being in fluid communication with said reservoirs and dispensing a selected amount of ink through said ejection orifice upon receipt of said control signals by said transducer element.

46. The ink jet marker as in claim 32 wherein said ink chamber is generally cylindrical and wherein said transducer element is disposed in surrounding relation to said ink chamber.

47. The ink jet marker as in claim 39 wherein each of said ejection nozzles comprises an ink chamber, an ejection orifice, and a transducer element.

48. The ink jet marker as in claim 39 further comprising a flexible hose.

49. The ink jet marker as in claim 39 wherein said enclosure further includes a third reservoir of a third ink and wherein said ink jet printing head includes a third ejection nozzle coupled with said third reservoir of ink and being adapted to dispense a selected amount of ink upon receipt of said control signals.

50. The ink jet marker as in claim 49 wherein said third ink is of a third color.

51. The ink jet marker as in claim 39 wherein said ink jet printing head includes:

at least one heater element, said heater element being disposed in a firing chamber.

52. The ink jet marker as in claim 39 wherein said control signals are applied to desired ones of said ejection nozzles in response to user input concerning a desired color.

53. A replaceable cartridge for use in a hand held ink jet writing instrument including a writing instrument body and an electrical circuit disposed to provide a plurality of control signals, said cartridge comprising:

an enclosure containing a first reservoir of a first ink and a second reservoir of a second ink adapted for placement within the writing instrument body;

an ink jet printing head including a first ejection nozzle being in fluid communication with said first reservoir and a second ejection nozzle being in fluid communication with said second reservoir, each of said ejection nozzles adapted to dispense a selected amount of ink upon receipt of said control signals; and an electrical interconnect arrangement disposed to connect said ink jet printing head with the electrical circuit.

54. The replaceable cartridge as in claim 53 wherein said first ink is of a first color and said second ink is of a second color.

55. The replaceable cartridge as in claim 54 wherein said enclosure further includes a third reservoir of a third ink and wherein said print head includes a third ejection nozzle coupled with said third reservoir of ink and dispensing a selected amount of ink upon receipt of said control signals.

56. The replaceable cartridge as in claim 55 wherein said third ink is of a third color.

57. The replaceable cartridge as in claim 56 wherein a mix of colors is dispensed by said ink jet printing head in response to user input concerning a desired color.

58. The replaceable cartridge as in claim 53 further comprising input controls permitting selection of a mix of colors in response to user input concerning a desired color.

59. The replaceable cartridge as in claim 53 wherein said ink jet printing head further comprises a transducer element, an ink chamber in spaced relation from said transducer element, and an ejection orifice disposed at one end of said ink chamber, said ink chamber being in fluid communication with said first reservoir and dispensing a selected amount of ink through said ejection orifice upon receipt of said control signals by said transducer element.

60. The replaceable cartridge as in claim 59 wherein said ink chamber is generally cylindrical and wherein said transducer element is disposed in surrounding relation to said ink chamber.

61. The replaceable cartridge as in claim 53 wherein said ink jet printing head comprises a plurality of spaced ejection nozzles, each of which is in fluid communication with said first reservoir.

62. The replaceable cartridge as in claim 61 wherein each of said ejection nozzles comprises an ink chamber, an ejection orifice, a transducer element.

63. The replaceable cartridge as in claim 53 further comprising a flexible hose connected between said enclosure and said ink jet printing head providing fluid communication therebetween.

64. The replaceable cartridge as in claim 53 wherein said first ink is of a first color and said second ink is of a second color.

65. The replaceable cartridge as in claim 53 where in said enclosure further includes a third reservoir of a third ink and wherein said ink jet printing head includes a third ejection nozzle coupled with said third reservoir of ink and being adapted to dispense a selected amount of ink upon receipt of said control signals.

66. The replaceable cartridge as in claim 65 wherein said third ink is of a third color.

67. The replaceable cartridge as in claim 53 wherein said ink jet printing head includes:

at least one heater element, said heater element being disposed in a firing chamber.

68. The ink jet marker as in claim 53 wherein said control signals are applied to desired ones of said ejection nozzles in response to user input concerning a desired color.

69. An ink jet marker comprising:

an hand-held writing instrument body;

a cartridge provided as a separable, self-contained unit adapted to be inserted within the writing instrument body, the cartridge including a plurality of reservoirs of ink, each containing ink of a different color;

said cartridge further including a thermal ink jet print-head disposed at one end of said instrument body when said cartridge is inserted therein, said print-head including a plurality of ejection nozzles, each of which is in fluid communication with a corresponding one of said reservoirs of ink, said ejection nozzles projecting droplets of ink in accordance with control signals received by said ink jet print-head; and a microprocessor-based electrical circuit coupled to said ink jet print-head disposed to provide said control signals to expel droplets of ink through desired ones of said ink jet print-head nozzles, said droplets of ink providing an image in the form of a colorized pattern onto a medium that is perceptible as a conventional marker to a user.

70. The ink jet marker as in claim 69 wherein said electrical circuit is disposed within said writing instrument body.

71. The ink jet marker as in claim 69 wherein said electrical circuit is disposed at a remote location from said body.

72. The ink jet marker as in claim 71 wherein said electrical circuit and said print-head are connected via electrical wiring.

73. The ink jet marker as in claim 69 wherein said electrical circuit includes synchronization and selection circuit means and applies control signals to desired ones of said ejection nozzles in response to user input concerning a desired pattern.

74. The ink jet marker as in claim 69 wherein said ink jet print-head includes:

at least one heater element, said heater element being disposed in a firing chamber.

75. The ink jet marker as in claim 69 wherein said ink jet print head includes:

at least one heater element, said heater element being disposed in a firing chamber supplied with ink from said ink reservoir, and a nozzle member including at least one nozzle associated with said heater element, through which droplets of ink are expelled toward said print medium when said heater element is actuated.

76. The ink jet marker as in claim 69 wherein said electrical circuit provides control signals to desired ones of said ejection nozzles in response to user input concerning a desired color.

* * * * *

UNITED STATES PATENT AND TRADEMARK OFFICE

CERTIFICATE OF CORRECTION

PATENT NO. : 6,422,698 B2
DATED : July 23, 2002
INVENTOR(S) : Richard J. Kaiser

It is certified that error appears in the above-identified patent and that said Letters Patent is hereby corrected as shown below:

Column 12,
Line 5, “an” should read -- a --.
Line 53, “32” should read -- 45 --.

Column 14,
Line 15, “an” should read -- a --.

Signed and Sealed this

Third Day of December, 2002

JAMES E. ROGAN
*Director of the United States Patent and Trademark Office*